US005778635A

United States Patent [19]

Galandrino

[11] Patent Number: 5,778,635

[45] Date of Patent: Jul. 14, 1998

[54] MACHINE FOR APPLYING HEAT-SEALABLE PILFERPROOF DISKS TO BOTTLES OF WINE LIQUOR BEVERAGES IN GENERAL AND THE LIKE

[75] Inventor: Agostino Galandrino, Canelli, Italy

[73] Assignee: Robino & Galandrino S.p.A., Canelli, Italy

[21] Appl. No.: 857,829

[22] Filed: May 16, 1997

[30] Foreign Application Priority Data

May 23, 1996 [IT] Italy ..... T096 A 000441
Nov. 21, 1996 [IT] Italy ..... T096 U 000236

[51] Int. Cl.[6] ..... B67B 1/10; B65B 7/28

[52] U.S. Cl. ..... 53/306

[58] Field of Search ..... 53/306, 308, 310, 53/312, 485, 329.4

[56] References Cited

U.S. PATENT DOCUMENTS

| | | | |
|---|---|---|---|
| 3,309,838 | 3/1967 | Wilhere | 53/306 X |
| 3,629,989 | 12/1971 | Reinecke | 53/306 X |
| 3,755,987 | 9/1973 | Dardaine et al. | 53/306 X |
| 3,759,012 | 9/1973 | Pagay | 53/306 |
| 3,882,660 | 5/1975 | Sterling | 53/308 |
| 4,719,739 | 1/1988 | Foldesi | 53/306 |
| 5,050,369 | 9/1991 | Fiwek et al. | 53/306 |

*Primary Examiner*—Horace M. Culver
*Attorney, Agent, or Firm*—Guido Modiano; Albert Josif

[57] ABSTRACT

The machine comprises rotating elements associated with a rotating shaft and adapted to guide the bottles, keeping them mutually spaced, along a first circular-arc path; a plurality of pneumatic heads which are also associated with the rotating shaft and follow the bottles along the circular-arc path, moving from a position for picking up individual disks from a corresponding stack contained in a disk magazine located to the side of the rotating elements, to a position for depositing the disks on individual and corresponding bottles which are fed continuously by a conveyor belt; and a pair of fixed slotted cams interacting with the pneumatic heads to keep each head temporarily stationary above the stack of disks in order to pick up each one of the disks by suction and to make the heads follow each bottle along the corresponding path in order to pneumatically deposit the disk on the bottle.

17 Claims, 7 Drawing Sheets

MACHINE FOR APPLYING HEAT-SEALABLE PILFERPROOF DISKS TO BOTTLES OF WINE LIQUOR BEVERAGES IN GENERAL AND THE LIKE

BACKGROUND OF THE INVENTION

The present invention relates to a machine for applying heat-sealable pilferproof disks to bottles of wine, liquor and beverages in general and particularly to bottles closed by means of corks or the like, the extraction whereof entails using corkscrew tools adapted to penetrate the material of said cork from the outside.

In these bottles, the genuineness of the content is guaranteed only if there is absolutely no trace of tampering or replacement of the original stopper. Stopper-covering caps are placed over bottle stoppers for this purpose, but because of the nature of the materials currently used to replace the traditional lead—which has now been eliminated owing to its known and acknowledged toxicity—on the one hand they do not ensure total pilferproofing of the stopper and on the other hand they have problems in terms of cost and/or pollution and/or recovery and recycling of bottle glass.

In particular, conventional caps made of polylaminate (aluminum-plastic-aluminum) do not anchor adequately to the glass of the bottle and therefore can be easily removed, negatively affecting the pilferproofing of the bottle contents. Tin caps, which are more similar to lead caps in terms of behavior, are excessively expensive and difficult to handle during fitting and caps made of heat-shrinking material (PVC) lead to higher costs for the recovery of the glass of the bottles due to the need to remove the residual portions of the cap which remain coupled to the glass.

The presence of tin cap residues on the bottles, in case of glass recycling performed by remelting in a blast furnace, produces damaging metal impurities which, by mixing in with the glass, significantly alter its quality, whilst residues of heat-shrinking caps, if subjected to heat treatment, generate dioxin, with consequent severe atmospheric pollution.

Other drawbacks of stopper-covering caps are their brittleness and bulk; accordingly, said caps require expensive and bulky packaging with consequent high transport, handling and storage costs.

Alternative sealing systems have been proposed as a replacement for said stopper-covering caps, substantially, sealing the stopper by depositing a wax disk on the stopper, which is placed a few millimeters below the mouth of the bottle, and using metal sealing disks which are heat-sealed to the mouth of the bottle. The first system has not yielded entirely satisfactory results, because during uncorking it produces wax fragments which can get into the bottle and/or glasses and therefore into the wine or beverage, compromising its taste. The second system is instead being met with approval by producers of wines, liquors and the like, but currently there are no technologies and machines for applying these disks having industrially satisfactory yields in terms of treated bottles per time unit.

SUMMARY OF THE INVENTION

A principal aim of the present invention is to provide a machine which is capable of continuously applying said pilferproof disks by taking them individually from a stack to deposit them on corresponding individual bottles which are fed continuously by the bottling station and are then sent, with the same feed rate, to a station for heating and polymerizing the layer of adhesive on the disk.

Another object of the invention is to provide a machine which is simple, reliable and inexpensive and can ensure high operating rates and therefore a corresponding high yield and substantially no rejects.

Another object of the invention is to provide a machine which can be easily and perfectly integrated in complete production plants which, starting from bottling, deliver the bottle corked, labeled and ready for marketing.

According to the present invention, this aim and other important objects are achieved by a machine for applying pilferproof disks having the specific features described in the appended claims.

Substantially, the present invention is based on the concept of providing a rotary-type machine having rotating means adapted to guide the bottles, keeping them mutually spaced, along a first circular-arc path, and a plurality of pneumatic heads, which also rotate and follow the bottles along their path, moving from a position for picking up individual disks from a corresponding stack contained in a disk magazine to a position for depositing them on individual and corresponding bottles which are fed continuously. The pneumatic heads are subjected to the interaction of two cams, adapted to make each head remain stationary above said stack of disks in order to pick up each disk by suction and to make said head follow each bottle along the corresponding path in order to pneumatically deposit the disk on said bottle.

According to the invention, each one of the pneumatic heads is supported at the end of a supporting element which can be substantially likened to an L-shaped lever having a first arm provided with an end roller engaging a first cam, a second arm lying at right angles to the first one and supporting the pneumatic head, and an intermediate fulcrum, with a virtual movable portion supported by the second arm and engaged in a second cam interacting with the first one.

The first cam is adapted to produce angular movements of the second arm of the L-shaped lever which are required to align the respective pneumatic head with the disk magazine and then with a bottle which arrives on a feeder conveyor belt, and to make said head follow said bottle along its circular-arc path.

The second cam is instead provided to move the movable portion of the fulcrum of the lever along a circular-arc path which is centered on the axis of the disk magazine. This is done in order to allow the second arm supporting the pneumatic head to temporarily rotate about said axis of the magazine when said axis coincides with the axis of the pneumatic head. Said head thus remains temporarily stationary and aligned with respect to the disk magazine in order to pick them up.

BRIEF DESCRIPTION OF THE DRAWINGS

The characteristics, purposes, and advantages of the machine according to the present invention will become apparent from the following detailed description and with reference to the accompanying drawings, given by way of non-limitative example and wherein.

DESCRIPTION OF THE PREFERRED EMBODIMENTS

Figure 4:
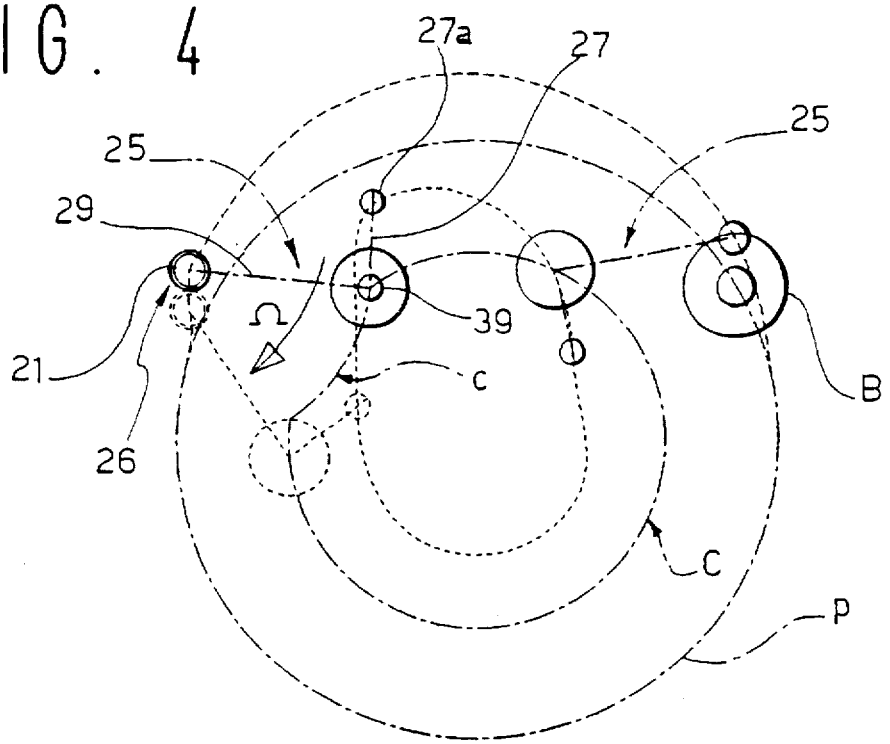
FIGS. 4, 4*a*, 4*b* and 4*c* are schematic views of the interaction of the first and second cams with respect to the levers supporting the pneumatic heads for picking up and depositing the pilferproof disks.

In the drawings, the reference numeral 10 generally designates the fixed table of a bench-like structure of the machine, supporting, with bearings 11 interposed, a rotating shaft 12 which is driven by an electric motor 14 by means of a pair of gears 13. To the side of the shaft 12 there is a conveyor 15 for bottles B which arrive from a preceding bottling station. The conveyor 15 is of the conventional type which comprises a belt 16 which moves in a straight line at constant speed and is flanked by a screw feeder 17 having the purpose of guiding the bottles, keeping them separated one from another by a preset spacing pitch. A so-called carousel, generally designated by the reference numeral 18, is associated with the rotating shaft 12 and is adapted to divert the bottles from the belt 16 and to make them travel along a first circular-arc path "p", covering an angle of 90° or a little more (FIG. 4), during which the individual bottles receive a corresponding pilferproof disk DG which is provided with a layer of pre-polymerized adhesive capable of making said disk adhere to the edge of the neck of the bottle.

Figure 1:
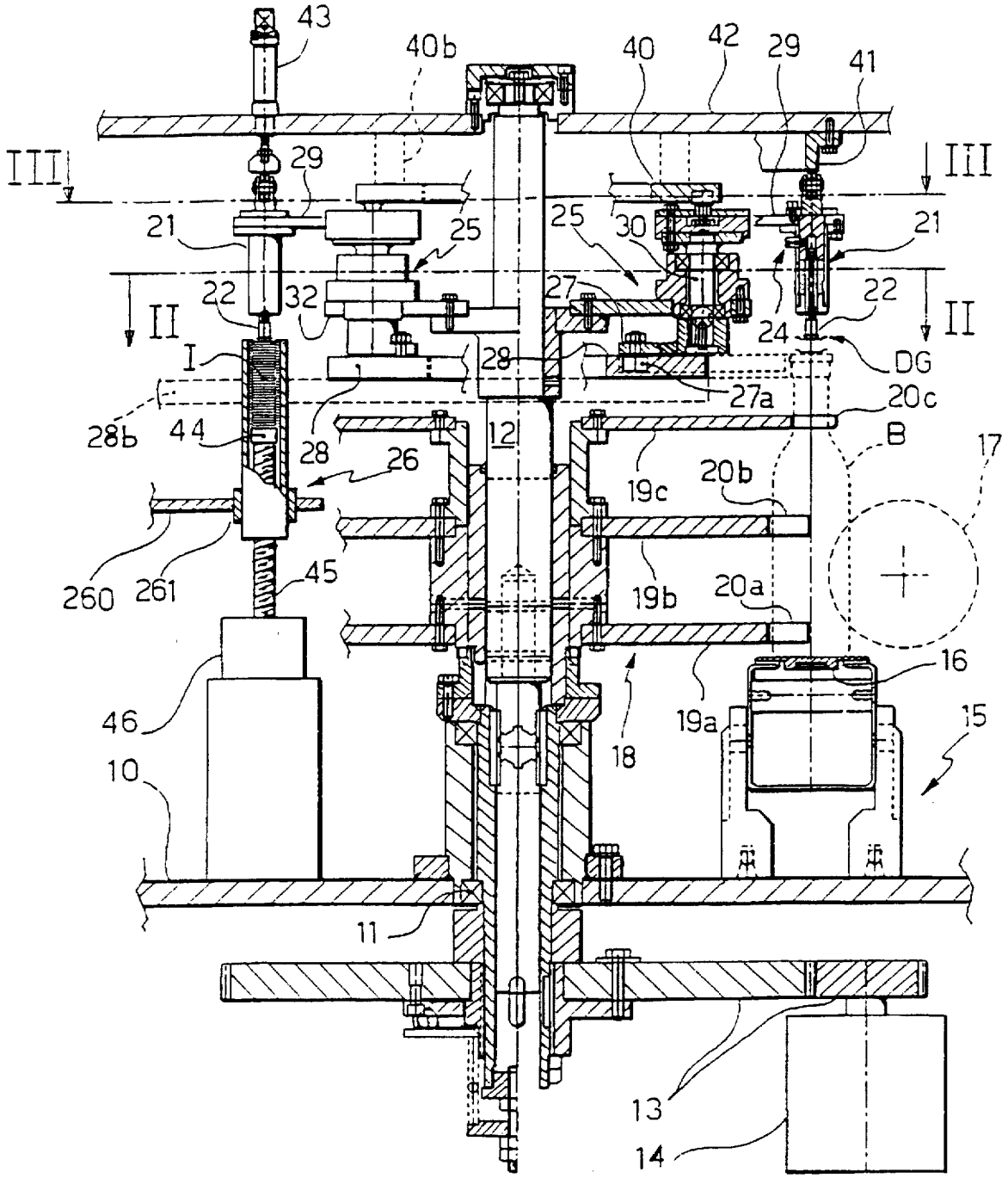
FIG. 1 is a sectional elevation view of the machine according to the invention.
Figure 2:
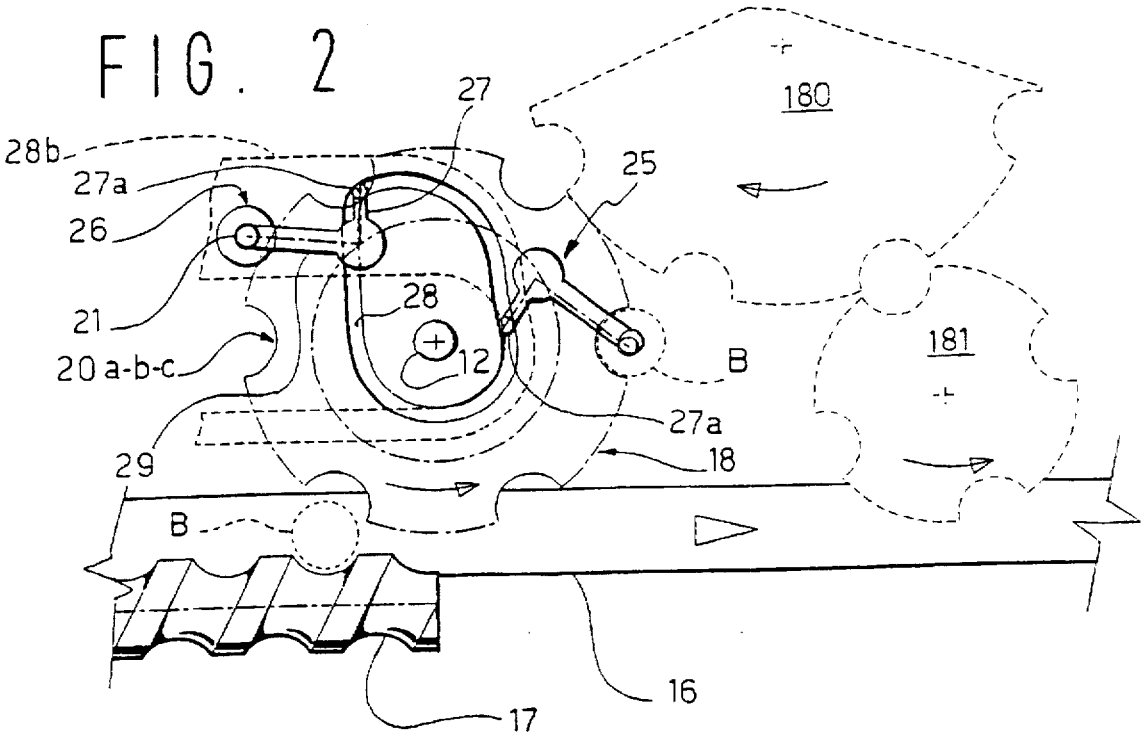
FIG. 2 is a schematic reduced-scale transverse sectional view, taken along the plane II—II of FIG. 1.

For this purpose, the carousel 18 is formed by a set of three stacked circular elements 19*a*–19*b*–19*c*, screwed on a hub which is rigidly coupled to the shaft 12; each one of said circular elements is provided with peripheral recesses 20*a*–20*b*–20*c*, uniformly spaced for example by 60° from each other and capable of accommodating and guiding respective bottles B as shown in FIGS. 1 and 2; the depth of the recesses is proportional, for each circular element, to the circumference of the cross-section of the bottle B at the level of said circular element.

A second carousel 180 is arranged adjacent to the carousel 18 and guides the bottles along a corresponding second circular-arc path P (FIG. 4*c*), along which heating heads, known and not shown, complete the polymerization of the adhesive, finally sealing the disks DG to the respective bottles; a third carousel 181 of the so-called exit star conveyor type, is provided to return the bottles, together with the corresponding disks, onto the belt 16 for removal (FIG. 2); the second carousel, with the corresponding heating heads, is shown schematically for the sake of completeness in description and is not part of the present invention.

A plurality of pneumatic heads 21 is provided above the carousel 18; said heads, too, rotate rigidly with the shaft 12, are typically equal in number to the recesses 20, and are angularly equidistant; in FIG. 2, only two pneumatic heads 21 are illustrated for the sake of better comprehension of the drawing. Each pneumatic head 21 is provided with a tip-located sucker 22 which can be selectively connected to a vacuum source or to a source of compressed air, not shown, by means of a duct 23 arranged inside said head, an outer tube 24 and a shunt valve, also not shown. Each head is supported by a supporting element, generally designated by the reference numeral 25, which rotates rigidly with the shaft 12 to move from a position for picking up individual disks, arranged in a stack I accommodated in a magazine 26, to a position for depositing said disks on individual and corresponding bottles arriving on the belt 16; the magazine 26 is also arranged to the side of the shaft 12 in a position wherein it does not interfere with the carousel 18. Each supporting element 25 can be substantially likened to an L-shaped lever having a first arm 27 provided with an end roller 27*a* engaging a first fixed slotted cam 28, a second arm 29 arranged at right angles to the first arm and provided with the respective pneumatic head 21, and an intermediate fulcrum 30, which is supported, so that it can rotate freely with bearings 31*a* interposed, by a bush 31 which is rigidly coupled to the peripheral region of a supporting disk 32 which rotates rigidly with the shaft 12. The fulcrum 30 comprises a virtual movable end portion 30*a* which can be moved out of alignment with respect to the axis "a" of the fulcrum and is supported by the second arm 29, which is in turn supported, so that it can move radially, by a head 33 which is rigidly coupled to the fulcrum 30.

A diametrical slot 34 (FIG. 1*b*) is formed in the head 33 for this purpose and contains, so that it can slide freely, the part 29*a* of the arm 29 which is provided with the corresponding movable end portion 30*a* of the fulcrum 30. The diametrical slot is closed, in order to retain the arm 29, by an upper cover 35 connected to the body of the head 33 by means of screws 36 and provided with a slot 37 allowing the passage of the movable end portion 30*a* while limiting the radial movement of the arm 29.

Figure 1A:
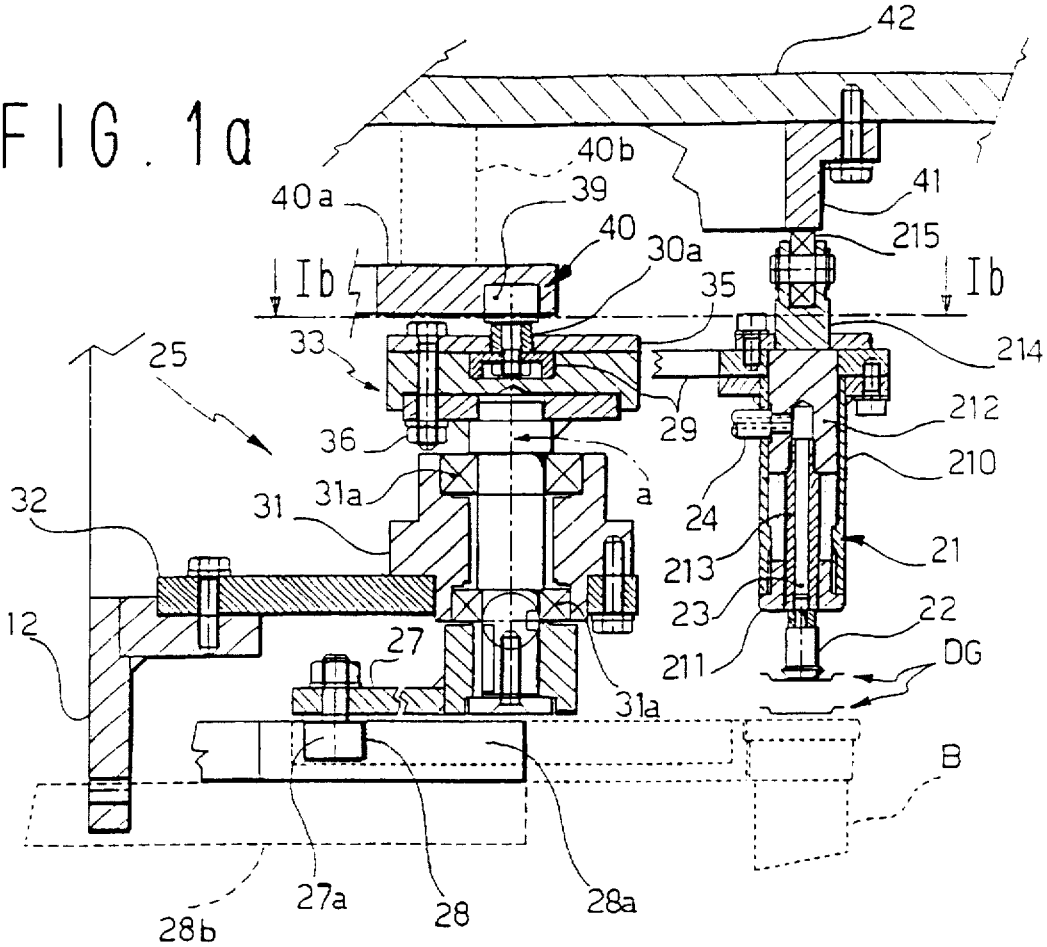
FIG. 1*a* is an enlarged-scale view of a detail of FIG. 1.
Figure 1B:
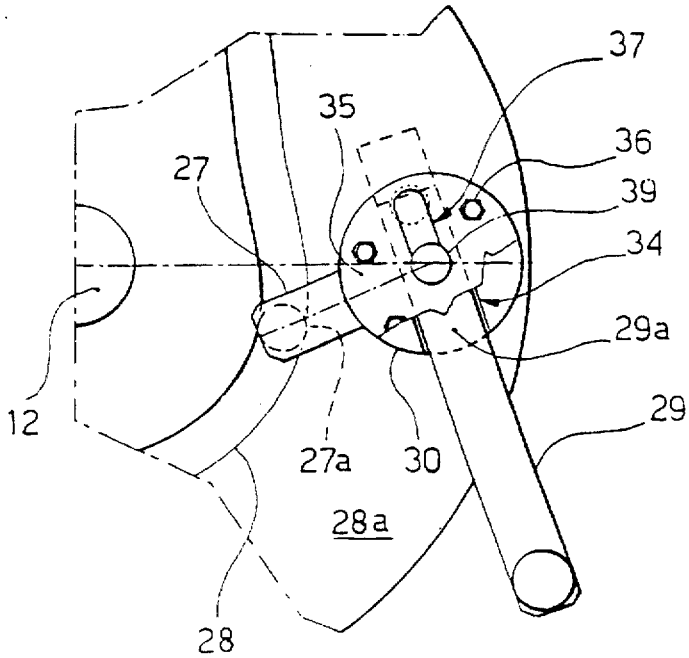
FIG. 1*b* is a sectional view, taken along the plane Ib—Ib of FIG. 1*a*.
Figure 1C:
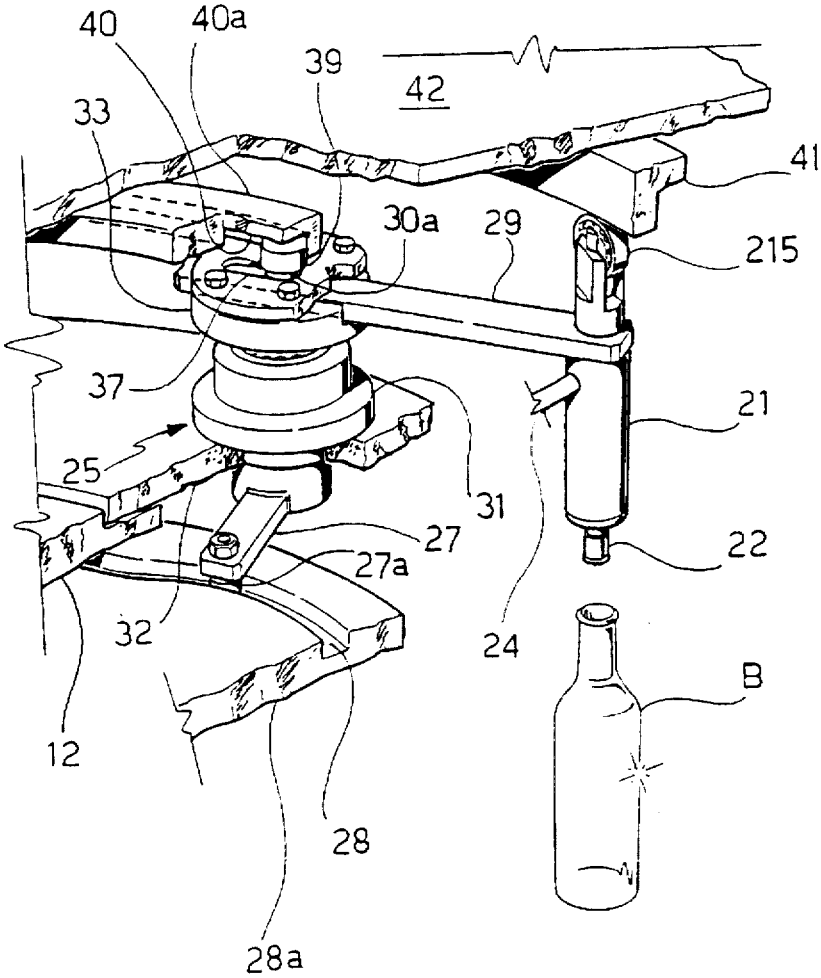
FIG. 1*c* is a perspective view of the detail of FIG. 1*a*.

As clearly shown in FIGS. 1*a*–1*c*, said movable end portion 30*a* of the fulcrum 30 is in turn provided with a roller 39 engaging a second fixed slotted cam 40. The first cam 28 and the second cam 40 are arranged respectively below and above the fulcrum 30 and are formed in corresponding annular elements 28*a*–40*a* which surround the shaft 12 and are supported by respective fixed supports 28*b*–40*b*. The cams 28–40 interact with the supporting elements 25; the first cam interacts in order to produce angular movements of each arm 29, which are required to move the respective pneumatic head 21 cyclically into alignment with the magazine 26 and then with the bottle B arriving on the belt 16, and to make said head follow the bottle along its first circular-arc path "p".

The second cam is instead provided in order to move the movable end portion 30*a* of the fulcrum 30 along a path "c" which is shaped like a circular arc centered on the axis of the magazine 26 (FIG. 3) in order to allow the temporary rotation "Ω" of the arm 29 that supports the head 21 about said axis of the stack I contained in the magazine when it coincides with the axis of said head. In this manner, each head 21, in rotating rigidly with the shaft 12, remains temporarily stationary on, and aligned with, the stack I of the magazine 26, allowing to pneumatically pick up the disks DG.

Figure 4C:
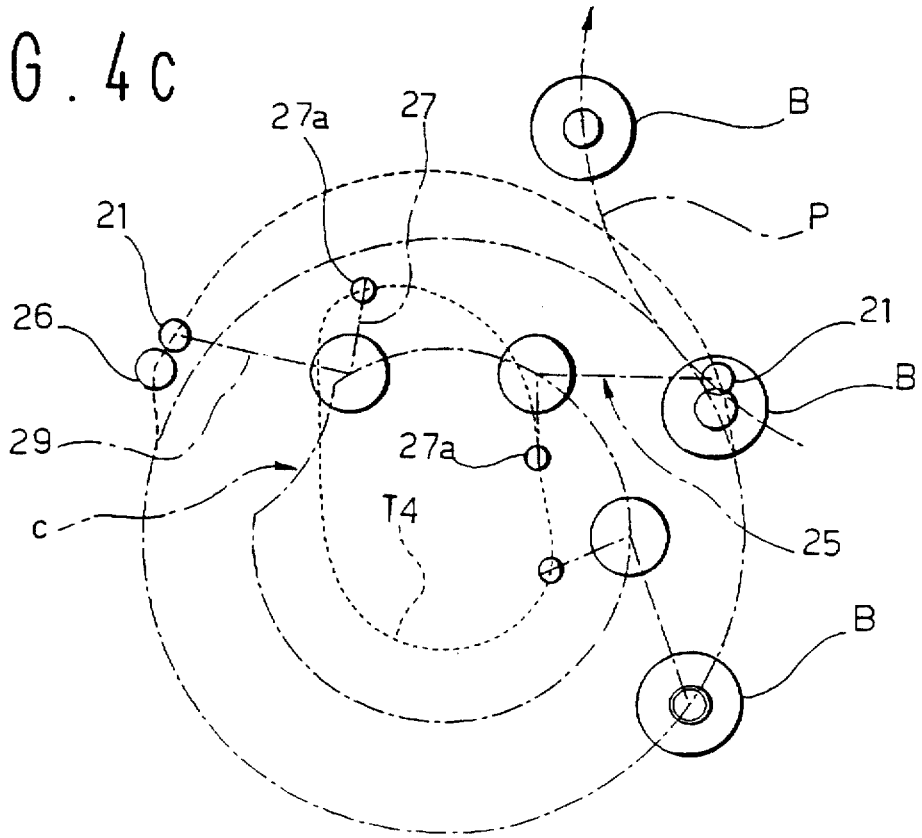
Figure 4A:
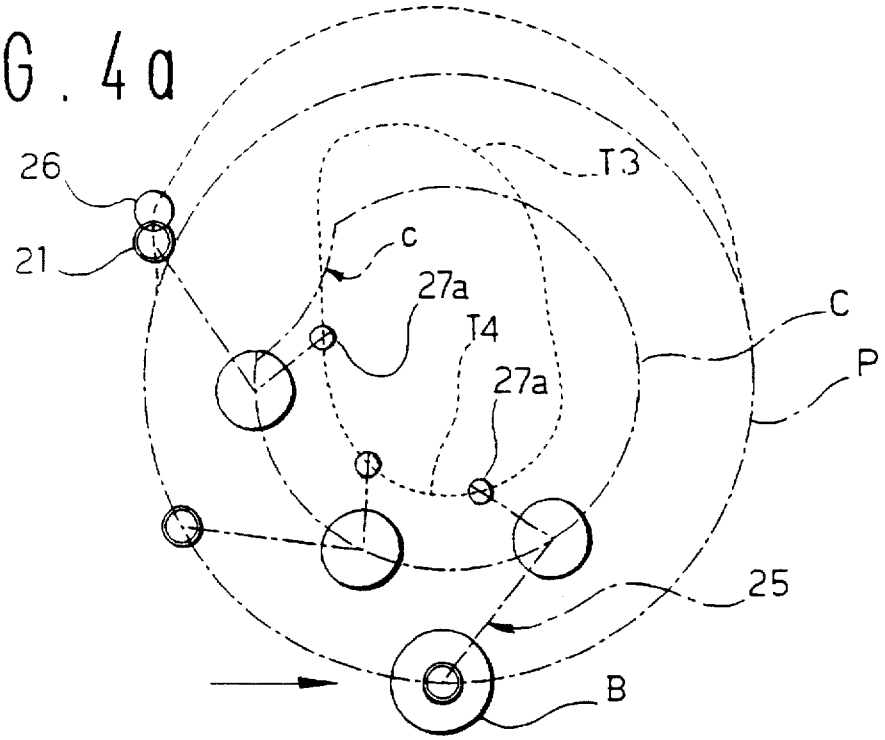
Figure 4B:
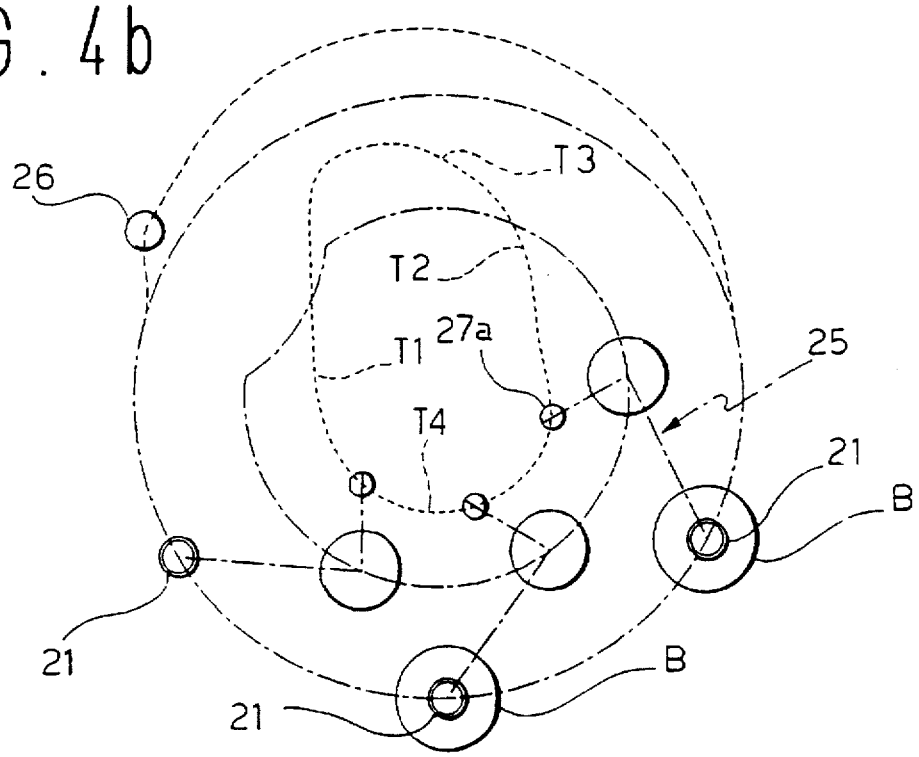

In order to provide the above angular movements and the temporary rotation of the arm 29, the slot 28 of the first cam is profiled as shown in FIG. 2 and in the diagrams of FIGS. 4*a*, 4*b* and 4*c*, which show that it comprises two mutually opposite and substantially straight portions T1, T2 which are joined by a first connecting portion T3 which is substantially curved and by a second portion T4 which is shaped like a circular arc centered on the axis of the shaft 12.

Figure 3:
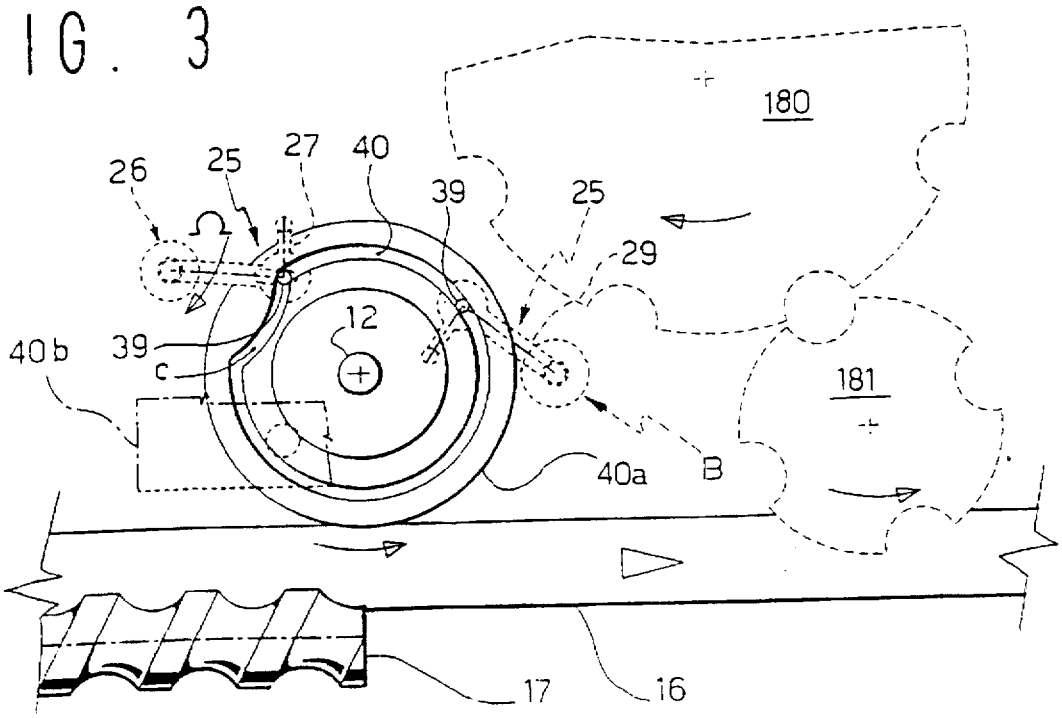
FIG. 3 is a schematic reduced-scale transverse sectional view, taken along the plane III—III of FIG. 1.

Correspondingly, the groove of the second cam 40 is profiled as shown in FIG. 3 and in the diagrams of FIGS.

4a–4b–4c, which show that it comprises a circular portion "C", which is concentric with respect to the shaft 12 and includes the circular-arc path "c" centered on the axis of the stack I contained in the magazine 26.

With reference again to FIG. 1a, it can be seen that each head 21 comprises a cylindrical body 210 which is closed by an end wall 211 and contains, so that it can slide in contrast with the action of a spring, a piston 212 provided with a sleeve 213 protruding from a hole of the end wall and provided with the sucker 22; the duct 23 is formed in the sleeve 12. The piston 212 is provided with an upper protrusion 214 protruding outside the body 210 and provided with a cam follower 215.

A third fixed cam 41, supported by a fixed support 42 arranged above the head 21, and a pneumatic cylinder 43, also supported by the fixed support 42, cooperate with the cam follower 215. The fixed cam 41 is constituted by a circular cam sector which is concentric to the shaft 12. Said cam sector covers an arc of approximately 90°, substantially equivalent to the first path "p" of the bottles, with which it is aligned in order to cause the lowering of the suckers 22 of the heads 21 onto said bottles, so as to deposit the disks DG, as soon as said bottles begin said path "p", during which the cam keeps said suckers lowered.

The pneumatic cylinder 43 is in turn aligned with the axis of the stack I of disks contained in the magazine 26 and is suitable to lower the sucker 22 of each pneumatic head 21 onto said stack in order to pick up the individual disks pneumatically.

For this purpose, when the sucker 22 is lowered onto said stack I, the duct 24 is connected to the suction source. As the disks are removed from the stack, said stack is pushed upward in order to substantially maintain the pickup level of the first disk of said stack. This is done by a leveling pusher 44 which is associated with the magazine 26 and cooperates with a threaded shaft 45 engaging a corresponding female thread driven by a motor 46 of the step type.

Figure 7:
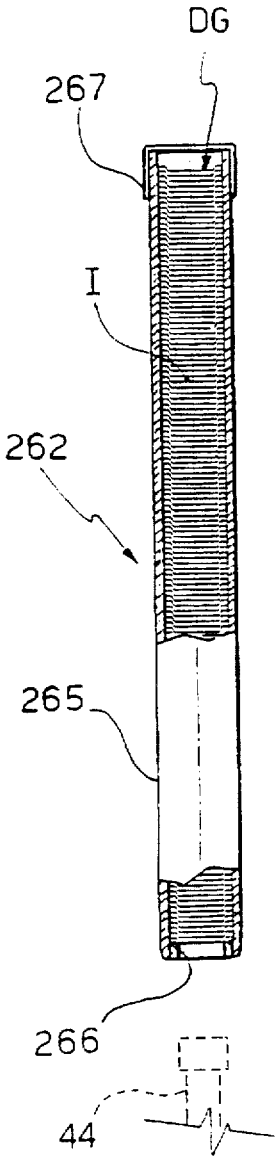
FIG. 7 is a partial enlarged-scale view, taken along the plane VII—VII of FIG. 6.
Figure 5:
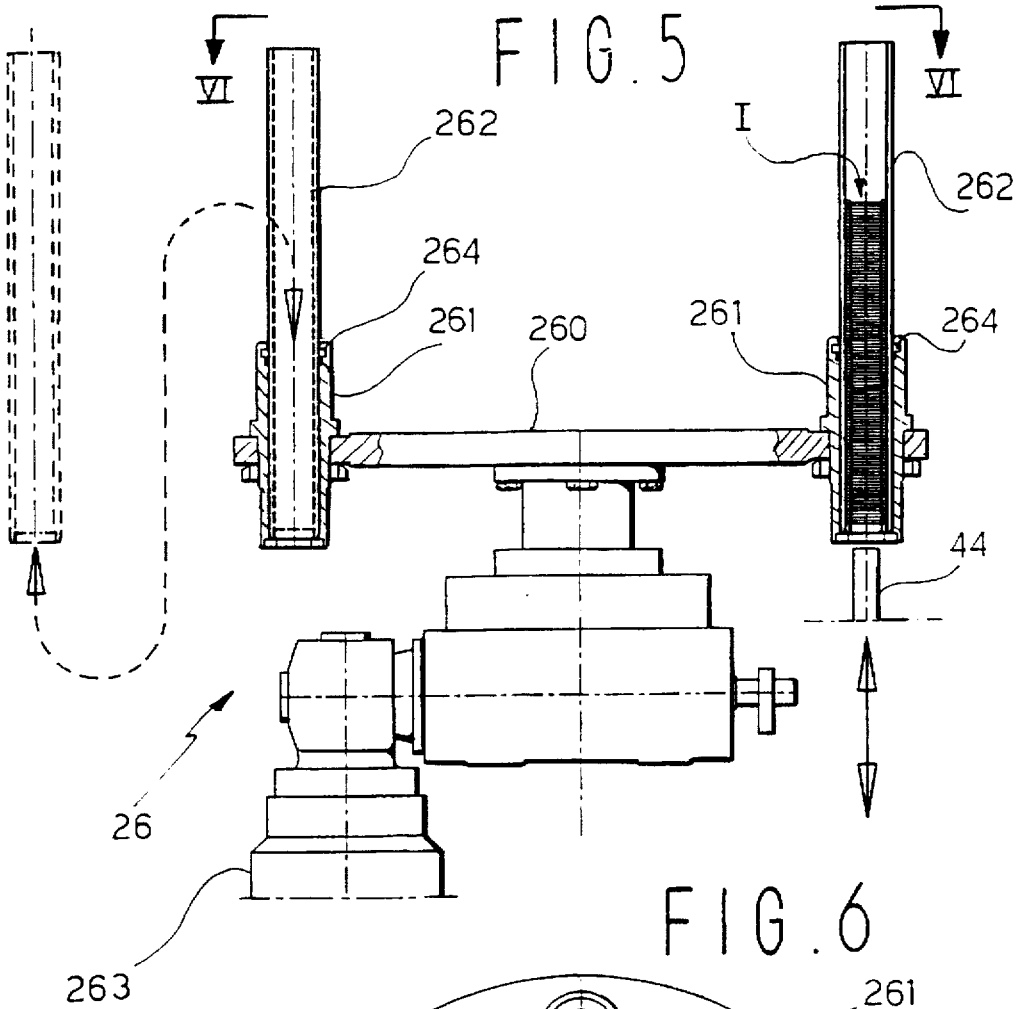
FIG. 5 is a partially sectional view of a preferred embodiment of the disk magazine associated with the machine of FIG. 1.
Figure 6:
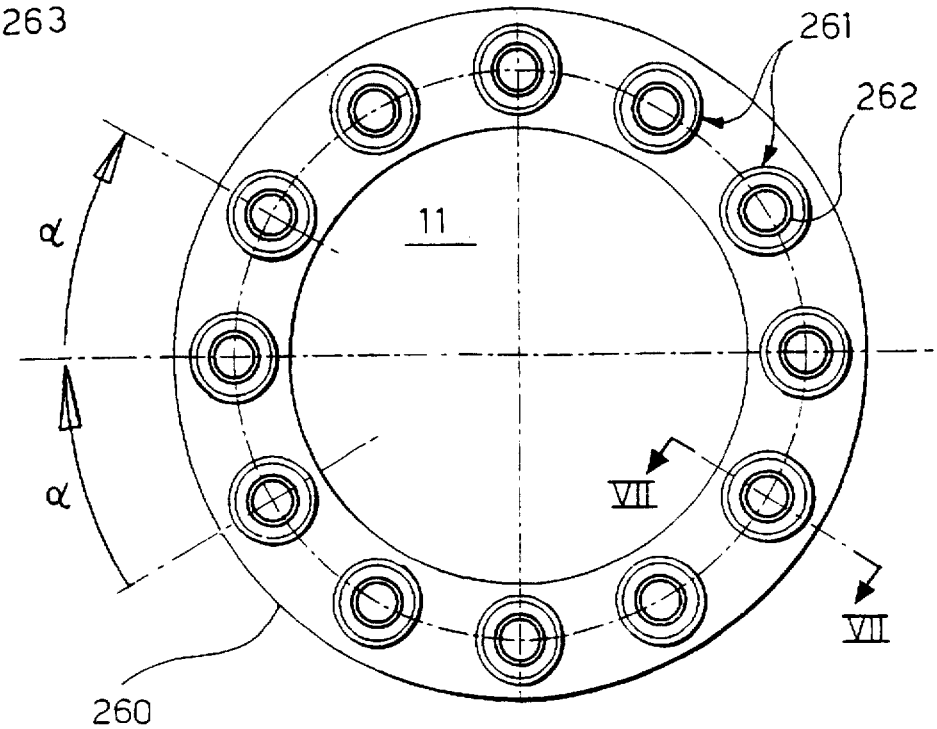
FIG. 6 is a plan view, taken in the direction of the arrows VI—VI of FIG. 5.

With reference now to FIGS. 5 to 7, a preferred embodiment of the disk magazine, generally designated by the reference numeral 26 in FIG. 1, is described. According to this embodiment, the magazine 26 comprises a movable support, preferably constituted by a circular element 260, which is provided with a plurality of cylinder seats 261 adapted to receive and removably retain a corresponding plurality of cartridges 262 for containing stacks I of heat-sealable disks DG. By means of a gearmotor 263 of a conventional type, not shown in detail, the circular element 260 can be rotated by angular steps covering an angle α which is equal to the angular spacing between the seats 261, so as to sequentially move, at each angular movement α, the individual cartridges 262 into alignment with the leveling pusher 44, allowing to replace a used-up cartridge with one filled with disks DG.

Each seat 261 receives, by snap-on coupling, the respective cartridge 262, which is detachably retained in said seat by the simple elastic action of a ring of flexible material 264 and can be extracted from the seat for replacement, as shown in dashed lines in FIG. 5, when the stack I of disks contained in it is used up. Each cartridge 262 can be refilled, and for this purpose it is constituted by a rigid cylindrical container 265 made of transparent polymeric material, having an annular end wall 266 which retains the disks of the stack I while allowing the leveling pusher 44 to pass when the cartridge is installed on the magazine 26.

According to the invention, the cartridge 262 also acts as recyclable packing container for shipping and storing the stacks I of disks; for this purpose, it is provided with a detachable cover 267 which can be closed, when the disks are packaged, with a removable adhesive tape or the like. The convenience of the magazine 26 according to the above described preferred embodiment is twofold, since on the one hand it allows to continuously feed the pilferproof disks DG to the machine which applies them to the bottles, allowing to replace the gradually used up cartridges with other refilled cartridges without this requiring any stop of said machine, and on the other hand it eliminates the need for the manufacturer of the disks to provide throwaway packages for shipping and storing said stacks of disks, with significant economic and ecological advantages.

What is claimed is:

1. A machine for applying heat-sealable pilferproof disks to bottles of wine, liquors and beverages in general, comprising: a rotating shaft; rotating means associated with said rotating shaft for guiding the bottles while keeping them mutually spaced along a circular-arc path; a conveyor belt for feeding said bottles; a disk magazine for said disks, located to a side of said rotating means; a plurality of pneumatic heads also associated with said rotating shaft, said pneumatic heads following the bottles along said circular-arc path and moving from a position for picking up individual disks from a corresponding stack contained in said disk magazine to a position for depositing said disks on individual and corresponding bottles which are fed continuously by said conveyor belt; and a pair of fixed cams, said cams interacting with said pneumatic heads to keep each said head temporarily stationary above said stack of disks in order to pick up each one of said disks by suction and to make said heads follow each bottle along said circular-arc corresponding path, in order to pneumatically deposit said disk on said bottle.

2. A machine according to claim 1, further comprising an electric motor, and wherein said rotating means for guiding the bottles along said circular-arc path and said pneumatic heads are rigidly coupled to a single said rotating shaft, said shaft being driven, with interposition of transmission gears, by said electric motor.

3. A machine according to claim 2, wherein said pneumatic heads are supported by respective supporting elements, said supporting elements rotating rigidly with said rotating shaft.

4. A machine according to claim 3, wherein each one of said supporting elements is a lever, said lever comprising a first arm and a second arm at right angles to each other, and a fulcrum, said fulcrum being intermediate with respect to said arms.

5. A machine according to claim 4, wherein said first arm of each supporting element is provided with a roller, said roller engaging a slot of a first one of said fixed cams, and said second arm is provided with a said respective pneumatic head.

6. A machine according to claim 5, wherein said intermediate fulcrum of each supporting element is provided with a virtual movable end portion, said end portion being rigidly coupled to said second arm and being movable out of alignment with respect to an axis of said fulcrum, and said end portion further comprising a roller for engaging a slot of a second one of said fixed cams.

7. A machine according to claim 6, further comprising a supporting head which is rigidly coupled to said fulcrum, said second arm being supported for radial movement by said head, and wherein said head is provided with a diametrical slot wherein said second arm is slidingly accommodated, said slot being closed by a cover provided with a further cover slot, said cover slot allowing passage of said movable end portion of the fulcrum while limiting radial movement of said second arm.

8. A machine according to claim 6, wherein said first and second fixed cams are formed in corresponding annular elements, said annular elements being supported by respective fixed supports concentrically with respect to said rotating shaft and on opposite sides with respect to a said fulcrum of a said supporting element.

9. A machine according to claim 5, wherein said first fixed cam is provided in order to produce angular movements of said second arm of each supporting element which are required to cyclically place a said respective pneumatic head in alignment with a said disk magazine and then with an incoming bottle and to make a said pneumatic head to follow the incoming bottle along said circular-arc path; said first cam comprising two mutually opposite portions substantially straight, said straight portions being connected by a first curved connecting portion and by a second connecting portion, said second connecting portion being shaped like a circular arc and being concentric with respect to said rotating shaft.

10. A machine according to claim 5, wherein said second fixed cam is provided so as to move a said virtual movable end portion of a said fulcrum of each said supporting element along a circular-arc path centered on an axis of a stack of disks contained in a said disk magazine, in order to allow temporary rotation of each said second arms supporting the pneumatic heads about said stack axis when said stack axis coincides with an axis of each pneumatic head, so that each pneumatic head remains temporarily stationary and aligned with respect to said magazine in order to pneumatically pick up said disks.

11. A machine according to claim 10, wherein said second cam comprises a circular portion which is concentric with respect to said rotating shaft, said circular portion including said circular-arc path which is concentric with respect to the axis of the stack of disks contained in said magazine.

12. A machine according to claim 11 comprising for each pneumatic head having a cylindrical body thereof, a pneumatic sucker; a piston; a sleeve; a spring; a pneumatic cylinder; and a third cam; said sleeve being rigidly coupled to said piston which is movable, in contrast with the action of said spring, in said cylindrical body of said pneumatic head, said piston being provided with an upper protrusion fitted with a cam follower with which said third fixed cam and said pneumatic cylinder cooperate, respectively, to lower said sucker into a position for depositing the disks on the respective bottles and to lower said sucker into a position for picking up said disks from the corresponding stack, said suckers being supported each at an end of a said respective sleeve.

13. A machine according to claim 1, wherein said magazine of the disks is provided with a leveling pusher and a step motor, said leveling pusher being driven by said step motor for keeping pick-up level of a first disk of the stack substantially unchanged.

14. A machine according to claim 13, wherein said disk magazine comprises a movable support; and a plurality of removable and refillable cartridges for containing respective stacks of disks associated with said movable support of said dick magazine, said removable cartridges also acting as recyclable packaging for said stacks of disks.

15. A machine according to claim 14, wherein said movable support is constituted by a movable disk which is movable by angular steps and is provided with a plurality of cylindrical seats for the snap-on coupling of corresponding removable cartridges, said cartridges being sequentially aligned, at each angular movement of said movable disk, with said leveling pusher.

16. A machine according to claim 15, wherein said seats for removable coupling of the cartridges are provided with respective rings of flexible material, said rings being adapted to retain said cartridges in said seat.

17. A machine according to claim 16, wherein each one of said cartridges is constituted by a rigid cylindrical container made of transparent polymeric material and having an annular end wall, said container retaining the stack of disks, while allowing the passage of said leveling pusher, the container being further provided with a detachable cover for imparting to said cartridge a function of a recyclable packaging for said stacks of disks.

* * * * *